US007335112B1

(12) United States Patent
Bitondo

(10) Patent No.: US 7,335,112 B1
(45) Date of Patent: Feb. 26, 2008

(54) ADJUSTABLE HEAD FOR A GOLF PUTTER

(76) Inventor: Gregory F. Bitondo, 1068 Dobbs Ferry Rd., White Plains, NY (US) 10607

( * ) Notice: Subject to any disclaimer, the term of this patent is extended or adjusted under 35 U.S.C. 154(b) by 0 days.

(21) Appl. No.: 11/616,862

(22) Filed: Dec. 28, 2006

(51) Int. Cl.
*A63B 69/36* (2006.01)
*A63B 53/06* (2006.01)

(52) U.S. Cl. ..... 473/238; 473/242; 473/244; 473/248

(58) Field of Classification Search ..... 473/219–256, 473/324–350
See application file for complete search history.

(56) References Cited

U.S. PATENT DOCUMENTS

| | | | | | |
|---|---|---|---|---|---|
| 1,352,020 | A | * | 9/1920 | Olson | 473/246 |
| 1,546,612 | A | * | 7/1925 | Barnes | 473/242 |
| 1,665,523 | A | * | 4/1928 | Boyce | 473/245 |
| 2,026,749 | A | * | 1/1936 | Pester | 473/245 |
| 2,175,598 | A | * | 10/1939 | Fedak | 473/245 |
| 2,219,670 | A | * | 10/1940 | Wettlaufer | 473/247 |
| 2,336,405 | A | * | 12/1943 | Kent | 473/245 |
| 2,477,438 | A | | 7/1949 | Brouwer | |
| 2,501,277 | A | * | 3/1950 | Hollopeter | 473/233 |
| 2,842,369 | A | * | 7/1958 | East | 473/242 |
| 3,214,170 | A | | 10/1965 | Warnock | |
| 4,067,572 | A | * | 1/1978 | Coleman | 473/245 |
| 4,073,492 | A | * | 2/1978 | Taylor | 473/409 |
| 4,174,108 | A | | 11/1979 | Reinholz | |
| 4,174,839 | A | * | 11/1979 | Marrs | 473/252 |
| 4,194,739 | A | | 3/1980 | Thompson | |
| 4,605,228 | A | | 8/1986 | Guendling, Jr. | |
| 4,778,180 | A | * | 10/1988 | Guenther | 473/248 |
| 5,244,205 | A | | 9/1993 | Melanson et al. | |
| 5,441,270 | A | | 8/1995 | Williams | |
| 5,441,273 | A | | 8/1995 | Stormon | |
| 5,447,313 | A | | 9/1995 | Finley | |
| 5,511,779 | A | | 4/1996 | Meyers et al. | |
| 5,533,730 | A | | 7/1996 | Ruvang | |
| 5,542,665 | A | | 8/1996 | Levocz | |
| 6,089,988 | A | | 7/2000 | Winslow | |
| 6,386,987 | B1 | * | 5/2002 | Lejeune, Jr. | 473/219 |
| 6,409,610 | B1 | | 6/2002 | Ahn | |
| 6,428,423 | B1 | | 8/2002 | Merko | |
| 6,979,269 | B1 | * | 12/2005 | Nohara | 473/244 |
| 2005/0227777 | A1 | | 10/2005 | Cover et al. | |
| 2006/0258475 | A1 | | 11/2006 | Lee | |

* cited by examiner

*Primary Examiner*—Sebastiano Passaniti
(74) *Attorney, Agent, or Firm*—Frank V. DeRosa, Esq.; Keusey, Tutunjian & Bitetto, P.C.

(57) ABSTRACT

An adjustable putter head for a golf putter is designed having an elongated line of sight marking on a top surface of the putter head to aid in aligning the putter head in a putting direction toward a target point, and a putter face which is pivotally connected to the putter head to allow selective adjustment of an angular position of the putter face relative to the line of sight for purposes such as adjusting a face angle orientation to compensate for improper putting strokes, or lining up breaking putts using the line of sight to aim the putt at the hole as a fixed target while adjusting the face angle orientation to align the ball striking face square to an off-line direction of intended ball movement.

10 Claims, 7 Drawing Sheets

*amount of offset at various feet.*

| | PUTTING DISTANCE FROM BALL TO HOLE, *(in feet)* | | | | | | |
|---|---|---|---|---|---|---|---|
| | 5' | 7' | 9' | 11' | 13' | 15' | 17' |
| | AMOUNT OF OFFSET AT HOLE, *(in inches)* | | | | | | |
| 1/16 | 1.0 | 1.4 | 1.8 | 2.2 | 2.6 | 3.0 | 3.4 |
| 1/8 | 2.0 | 2.8 | 3.6 | 4.4 | 5.2 | 6.0 | 6.8 |
| 3/16 | 3.0 | 4.2 | 5.4 | 6.6 | 7.8 | 9.0 | 10.0 |
| 1/4 | 4.0 | 6.0 | 7.2 | 8.8 | 10.4 | 12.0 | 13.6 |
| 5/16 | 5.0 | 7.0 | 9.0 | 11.0 | 13.0 | 15.0 | 17.0 |
| 3/8 | 6.0 | 8.4 | 10.8 | 13.2 | 15.6 | 18.0 | 20.4 |
| 7/16 | 7.0 | 9.8 | 12.6 | 15.4 | 18.2 | 21.0 | 23.8 |
| 1/2 | 8.0 | 11.2 | 14.4 | 17.6 | 20.8 | 24.0 | 27.2 |
| 9/16 | 9.0 | 12.6 | 16.2 | 19.8 | 23.4 | 27.0 | 30.6 |
| 5/8 | 10.0 | 14.0 | 18.0 | 22.0 | 26.0 | 30.0 | 34.0 |

ADJUSTABLE HEAD FOR A GOLF PUTTER

TECHNICAL FIELD OF THE INVENTION

The present invention relates generally to golf clubs having adjustable club heads and, in particular, to an adjustable putter head for a golf putter, having an elongated line of sight marking on a top surface of the putter head to aid in aligning the putter head in a putting direction toward a target point, and a putter face which is pivotally connected to the putter head to allow selective adjustment of an angular position of the putter face relative to the line of sight for purposes such as adjusting a face angle orientation to compensate for improper putting strokes or lining up breaking putts using the line of sight to aim the putt at the hole as a fixed target while adjusting the face angle orientation to align the ball striking face square to an off-line direction of intended ball movement.

BACKGROUND

One of the most challenging aspects of the game of golf involves putting as putting accuracy is based on many factors including, for example, the skill level and ability of the individual, the type of putter used by the individual, etc. By way of specific example, putting accuracy is based on an individual's ability to "read the green" to determine what path a golf ball should travel along the putting green to reach the target hole, and then "line up" the putt according to the green reading. The term "read the green" generally refers to the process of examining the slope, texture, borrow, etc. of the putting green in order to determine how the putting green may affect the path that a golf ball will travel towards the hole, e.g., whether the golf ball will break right or left while rolling towards the hole. The term "lining up" the putt generally refers to a process of selecting a target point, visualizing a target line (or aim line), i.e., a straight line extending from the center of the golf ball to the selected target point, and aligning the putter head relative to the ball and target line such that a point impact of the putter face against the golf ball is directed along the target line extending from the center of the golf ball to the target point.

A golfer may line up a putt by selecting a target hole as an aiming point and then aligning the putter head directly at the target hole (e.g., dead center of hole) to putt the ball in a direction of a straight line extending from the center of the golf ball to the target hole. However, a putt is rarely aimed directly dead center at a target hole because there is typically a left or right break (however slight it may be) in the green. In this regard, the golfer can compensate for the break by lining up to make a breaking putt, e.g., selecting a target point at some distance to the left or right of the target hole and aligning the putter head to putt the ball in the direction along a target line extending from the center of the ball to the target point, with the expectation that the putt will break away from the target line and follow a curved path toward the hole.

By way of example, FIG. 10 schematically illustrates methods for lining up a putt using a conventional putter. In general, FIG. 10 schematically depicts a putter head (1) golf ball (2) and a hole (3) formed in a putting green. Conventional putter heads are typically designed with putter faces having flat ball striking faces. In this regard, for illustrative purposes, the putter head (1) in FIG. 10 is generically depicted as a planar element having a planar ball striking face (1A).

A line $L_{BH}$ (ball-to-hole line) denotes a target putting line extending from the center of the golf ball (2) directly to the hole (3). As noted above, a putt may be performed by selecting the hole (3) as a target point and lining up the direction of the putt to aim straight towards the hole (3) along the ball-to-hole line, but this type of putt is uncommon as the aim line is typically adjusted based on an amount of break that is determined based on a green reading (and other factors such as wind, etc.)

In this regard, FIG. 10 depicts a line $L_{TP}$ (ball-to-target point line) which denotes a target putting line extending from the center of the ball (2) to a target point $T_P$ located at a distance $D_{Break}$ to the left of the center of the hole (3), for purposes of making a breaking putt. The line $L_{TP}$ points in the direction of an off-line path which is offset at an angle $\theta$ from the direction of line $L_{BH}$. The target point $T_P$ is selected based on an amount of break that is anticipated based on the slope, texture of the putting green, distance from the golf ball to the hole, velocity of the ball upon impact, etc. The curved line $P_{Break}$ denotes an anticipated curved path that a ball will travel towards the hole (3) to make the breaking putt.

Once the target point and target putting line are determined, a putt is performed by aligning the position of the putter head to aim square in the direction of the target, and then making a smooth stroke to send the golf ball rolling straight at the target point along the target line. In general, the accuracy of the putt depends on the point of impact on the strike face of the putter head at which contact is made to the golf ball during the stroke, as well as the angular orientation of the strike face relative to the target line upon impact. In particular, when making a putting stroke, putting accuracy depends on impacting the ball at a central area of the strike face, known in the art as the "sweet spot", while ensuring the strike face of the putter face is square (90 degrees) to the target line.

By way of example with reference to FIG. 10, when lining up to make the breaking putt along target line $L_{TP}$, a golfer would address the golf ball (2) by positioning the putter head (1) with the desired point of impact (sweet spot) of the strike face (1A) directly behind the ball to be struck and with the strike face (1A) square (perpendicular) to the target line $L_{TP}$. When making the stroke, the alignment must be maintained through the stroke such that the ball is hit at the sweet spot region of the ball striking face (1A) as such that the ball striking face (1A) is maintained at right angles to the target line at the time of contact.

Thus, when making a putt, a golfer must be able to visualize a target putting line extending from the ball center to a target point and then focus on such target line during a putting stroke to maintain the putter head in proper alignment so as to direct the "sweet spot" of the putter head at the center of the golf ball in the direction of the target putting line while holding the putter face square to the target line at the point of impact. In this regard, putting can be problematic especially when making breaking putts where a golfer must visualize and align to an invisible target line extending towards a blind spot (invisible aiming point) on the green.

SUMMARY OF THE INVENTION

In general, exemplary embodiments of the invention include golf clubs having adjustable club heads. In particular, an exemplary embodiment of the invention includes an adjustable putter head for a golf putter having an elongated line of sight marking on a top surface of the putter head to aid in aligning the putter head in a putting direction toward a target point, and a putter face which is pivotally connected to the putter head to allow selective adjustment of an angular position of the putter face relative to the line of sight. The selective adjustment serves various purposes such allowing a golfer to adjust a face angle orientation of the putter head to compensate for improper putting strokes or enabling a golfer to line up breaking putts using the line of sight to aim the putt at the hole as a fixed target while adjusting the face angle orientation to align the ball striking face square to a desired off-line direction of intended ball movement.

More specifically, in one exemplary embodiment of the invention, an adjustable golf putter head includes a putter body and a putter face having a planar ball striking face. The putter body comprises an alignment line formed on a top surface of the putter body, which extends and points in a direction that defines a putting direction of the putter head and which serves as a visual aid to align the putting direction of the putter head in a direction of a target line toward a target point. The putter face is pivotally connected to the putter body to selectively adjust a face angle of the putter face relative to the alignment line to one of a plurality of face angle positions including a square face angle position where the planar ball striking face is perpendicular to the alignment line, and open face angle and closed face angle positions where the planar ball striking face is not perpendicular to the alignment line.

In another embodiment, an adjustable golf putter head includes a face plate comprising a planar ball striking face and a body member. The body member comprises an elongated alignment line formed on a top surface of the body member extending from a front portion to a back portion of the body member and pointing in a direction that defines a putting direction of the putter head and which serves as a visual aid to align the putting direction of the putter head in a direction of a target line toward a target point. The face plate is pivotally connected to the front portion of the body member to selectively adjust an angular position of the ball striking face relative to the alignment line between a reference position and an offset position. At the reference position, the ball striking face is positioned at an angle perpendicular to the alignment line, whereby the alignment line serves as a visual aid to position the ball striking face square to the putting direction toward the target point. At the offset position, the ball striking face is positioned at an offset angle from the reference position, whereby the alignment lines serves as a visual aid to position the ball striking face square to an off-line direction at the offset angle relative to the putting direction pointed to by the alignment line.

In other embodiments, the alignment line may be an elongated center line marking that extends from a front portion to a back portion of the top surface of the body, wherein the alignment line points to sweet spot region on the planar ball striking face. Further, the putter head may comprise a back plate that slideably engages the back portion of the body member to control and guide relative pivotal motion between the body member and face plate. The upper surface of the back plate can include face angle indicia providing a series of positional marks corresponding to different ones of the plurality of angular positions of the ball striking face relative to the alignment line, wherein a given angular position is selected by aligning the alignment line to a corresponding positional mark. The face angle indicia may comprise an arcuate sequence of colored circles arranged along an outer arcuate edge of the upper surface of the back plate, wherein the positional marks are delineated by centers and edges of the colored circles.

These and other exemplary embodiments, aspects, features and advantages, of the present invention will become apparent from the following detailed description of exemplary embodiments, that is to be read in connection with the accompanying drawings.

DETAILED DESCRIPTION OF EXEMPLARY EMBODIMENTS

Figure 1A:
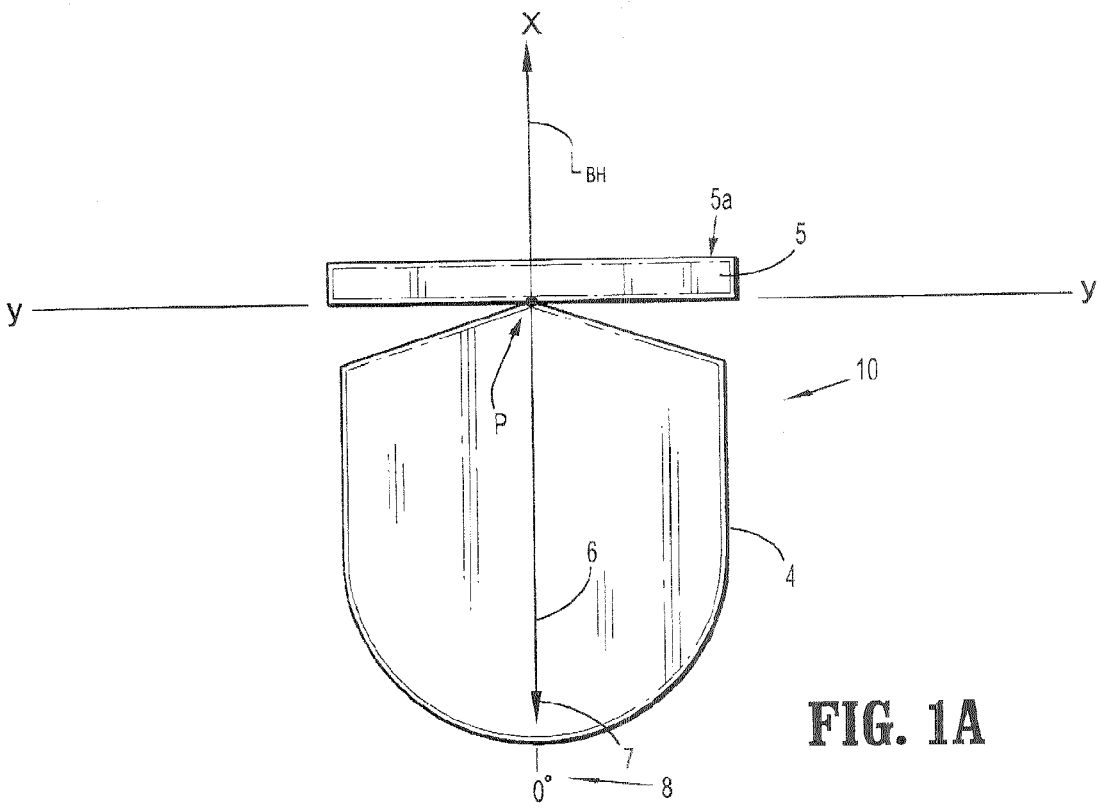
FIGS. 1A and 1B are high-level top plan schematic illustrations of an adjustable putter head according to an exemplary embodiment of the invention.
Figure 1B:
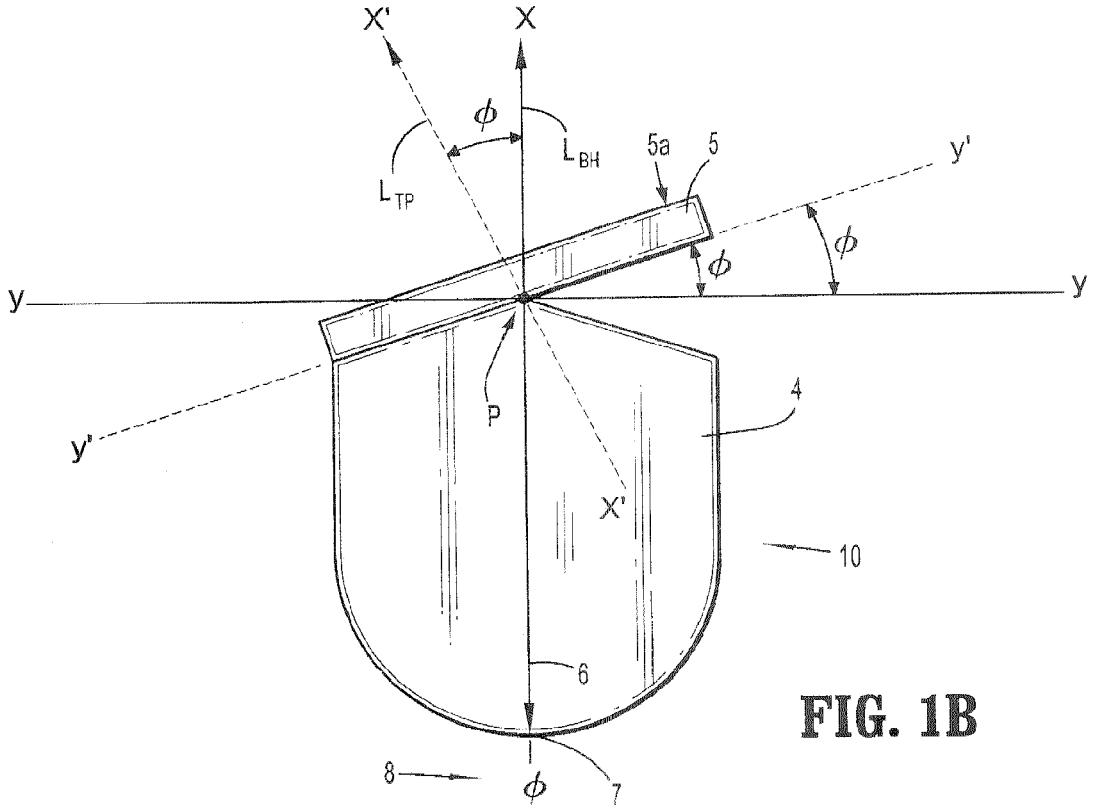

FIGS. 1A and 1B are high-level top plan schematic illustrations of an adjustable putter head according to an exemplary embodiment of the invention. More specifically, FIGS. 1A and 1B depict a high-level, conceptual framework of an adjustable putter head (10) generally comprising a putter body (4), and a putter face (5) having a planar ball striking face (5*a*). The body (4) is adapted to be connected to a club shaft (not shown) and comprises an elongated line of sight (6) (or alignment line) which extends along the top surface of the putter body (4) from the front to the rear of the body (4) in a direction of a putting motion. The alignment line (6) is in fixed orientation with the club shaft. The alignment line (6) is a visual aid to assist the golfer in positioning the putter head to be squarely aligned in a direction of a target line (aim line) extending from a golf ball to a target point. Moreover, in the exemplary embodiment, the alignment line (6) is positioned in general alignment to point to the "sweet spot" or center portion of the striking face (5*a*) where contact with a golf ball is preferably made.

The body portion (4) and face portion (5) are pivotally connected about a point P to enable relative pivotal movement (or rotational movement) between the body (4) and face (5) about a pivot axis, wherein such relative rotational movement is in an arcuate direction along a plane (e.g., x-y plane) perpendicular to the pivot axis (z-axis) extending through the pivot point P. Such pivotal movement allows a golfer to selectively adjust an angular position of the ball striking face (5*a*) relative to the alignment line (6) between a reference position (or "zero offset" position) where the ball striking face (5*a*) is positioned at an angle perpendicular to alignment line (aligned square (90 degrees) to alignment line), and an offset position where the ball striking face (5*a*) is positioned at an offset angle relative to the reference position.

As will be explained in detail hereafter, with this conceptual framework, a golfer can use the alignment line (6) as a visual aid to line up the putting direction (putting motion) in line with (or otherwise parallel to) an aim line direction (ball-to-hole line) toward a target hole as a fixed target, while adjusting the angle of the striking face (5*a*) relative to the alignment line (6) such that the striking face (5*a*) is aligned square to an off-line direction relative to the putting direction aligned to the ball-to-hole line. This allows a golfer to make a breaking putt by using the line of sight (6) to aim the putt at the hole as a fixed target, while adjusting the strike face angle relative to the alignment line as desired to align the strike face (5*a*) square to the off-line direction of intended ball travel towards a target spot offset from the target hole.

By way of example, FIG. 1A denotes a "zero-offset" or reference position where the face (5) is positioned at an angular position relative to the alignment line (6) where the planar striking face (5*a*) is perpendicular to the alignment line (6) In particular, in the illustrative embodiment, the body (4) is depicted as being positioned such that the alignment line (6) is aligned to, and extending in, an x-direction (x-axis), and perpendicular to a y-axis, where the x-axis and y-axis define a horizontal plane. The body (4) and face (5) are assembled for pivotal movement about a pivot axis (z-axis) that is orthogonal to the x-y plane, where the pivot point P denotes a point at which the pivot axis intersects the alignment line (6). In FIG. 1A, the putter face (5) is angularly positioned relative to the body (4) such that the striking face (5*a*) is squarely aligned in the direction pointed to by the alignment line (6), such that direction of ball movement upon impact is "in-line" with the aim line.

In particular, when lining up a putt using the club head configuration depicted in FIG. 1A, the club head (10) is aligned by positioning the face (5) behind the ball at the sweet spot region of the striking face (5*a*) with the alignment line (6) pointing to the center of the golf ball and being aligned with a target line extending from the ball center toward a target point. For example, in FIG. 1A, the alignment line (6) may be aligned to point to a target hole along a target ball-to-hole line in the x-direction. Since the striking face (5*a*) is positioned square to the alignment direction, the ball will travel along the aiming direction aligned to the alignment line (6) when contact is made at the "sweet spot" of the striking face (5*a*).

The adjustable club head (10) can be manipulated to pivot the putter face (5) about the pivot point P to adjust the angle of the putter face (5*a*) relative to the alignment line (6) from the zero-reference position (perpendicular) (illustrated in FIG. 1A) to any desired offset angle in which the striking surface (5*a*) is positioned to be square to the direction of intended ball movement along an off-line ball path for making a breaking putt, while the alignment line (6) is used to line the putt in the direction along the ball-to-hole line. For example, FIG. 1B depicts an example in which face (5) is rotated about the pivot point P relative to the body (4) in a counterclockwise direction (arcuate direction in x-y plane) such that the angle of the striking face (5*a*) is orientated at an angle $\phi$ relative to the reference position where the striking face (5*a*) is perpendicular to the alignment line (6).

In the exemplary embodiment of FIG. 1B, the angular rotation of the face (5) relative to the body (4) is depicted by an angular rotation of the x-y axis about the z-axis to a position denoted by orthogonal x' and y' axis, where the x'-axis is depicted as being perpendicular to the strike face (5*a*) and the y'-axis is depicted as being parallel to the strike face (5*a*). The x'-axis represents the direction that is square to the putter face (5*a*), where the x-axis represents the direction which is aligned to, or otherwise parallel with, the alignment line (6) on the body (4). In other words, the angle $\phi$ represents the angular offset between the direction of the putter face (5A) relative to the direction of the alignment line (6). With this configuration, the angle of the striking face (5*a*) with respect to the alignment line (6) can be adjusted from the reference position (FIG. 1A) to some non-reference position (FIG. 1B) for purposes of making a breaking putt towards some target point offset from the target hole while lining up the putt in a putting direction toward the target hole.

Figure 10:
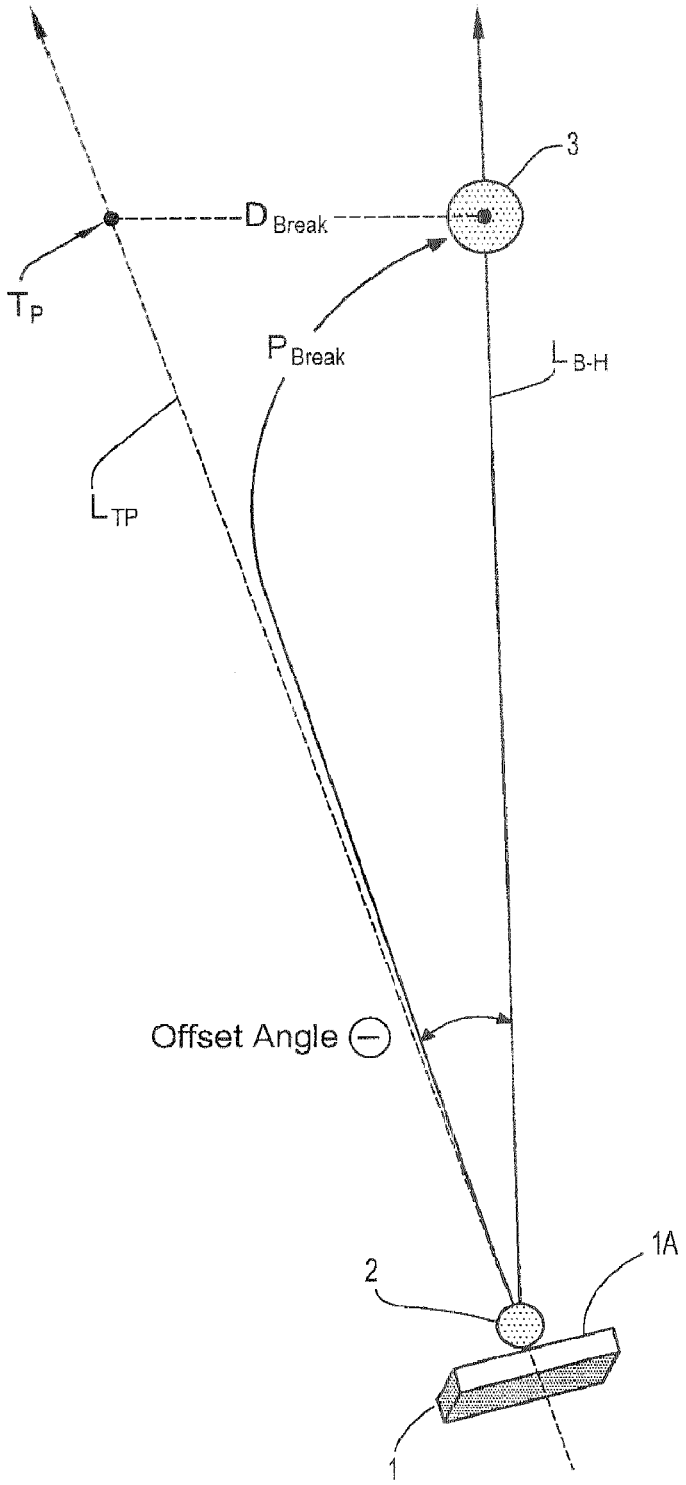
FIG. 10 (Prior Art)
FIG. 10 schematically illustrates method for lining up putts using a conventional putter.

By way of example, as discussed with reference to FIG. 10, when making a breaking putt, the golfer would select a target point located at a distance to the left (or right) of the center of the target hole and visualize a target line extending from the ball to the target point, where the target line extends in the direction of intended ball movement along an off-line path at some offset angle from the ball-to-hole line. As depicted in FIG. 1B, for illustrative purposes, the x-direction denotes a target ball-to-hole line $L_{BH}$, the x'-direction denotes a target line from the ball to an invisible target point to the left of the target hole, and the angle $\phi$ denotes the offset angle of the off-line ball path.

To make a breaking putt, the golfer would adjust the angle of the putter face (5*a*) relative to the alignment line (6) to achieve the desired offset angle. The club head (10) is placed in position behind the golf ball with the alignment line (6) pointing through the center of the golf ball and aligned to point in the putting direction along a ball-to-hole line. When the club head (10) is properly aligned in this position, the putter is aimed in the direction toward the target hole, while the striking face (5*a*) is positioned square to the direction of the intended ball movement along the target line from the ball to the target point. When contact is made to the ball in this alignment, the stroke will follow through in the aiming direction towards the target hole, while contact to the ball causes the ball to travel in the direction square to the striking face (5*a*), i.e., the direction of intended ball movement along the off-line path towards the target point.

As generally depicted in FIGS. 1A and 1B, the desired angular position may be determined by aligning a pointer (7) to angular indicia (8) (e.g., markings, slots) provided on the putter head to enable the amount of angular offset from a reference or "zero point". In FIG. 1A, the pointer (7) is depicted as being aligned in the direction of the alignment line (6) with the pointer (7) aligned to point to a "0" offset angular position mark (8) indicating that the planar ball striking face is aligned square to the direction of the alignment line). In FIG. 1B, the pointer (7) is depicted as pointing to an ϕ offset angular position mark (8) indicating that the planar ball striking face is aligned square to an off-line direction relative to the alignment line at an offset angle ϕ. As described below, various clamping or indexing means can be used to control the relative pivotal movement between the body (4) and face (5) and fixedly securing the elements in the desired pivotal relationship.

It is to be understood that FIGS. 1A and 1B depict a high-level, conceptual framework of an adjustable putter head according to an exemplary embodiment of the invention, as well as methods for lining up and making breaking putts according to exemplary embodiments of the invention. It is to be understood that adjustable putter heads according to the invention can be designed with frameworks, constructions that are widely varied and falling within the scope of the claimed inventions. In this regard, specific details regarding the design, construction, framework of adjustable putter heads as described herein should not be construed as placing limitations on the scope of the invention. For illustrative purposes, details of adjustable putter heads according to exemplary embodiments of the invention, which are based on the conceptual framework described above will now be discussed in further detail with regard to FIGS. 2-9.

Figure 2:
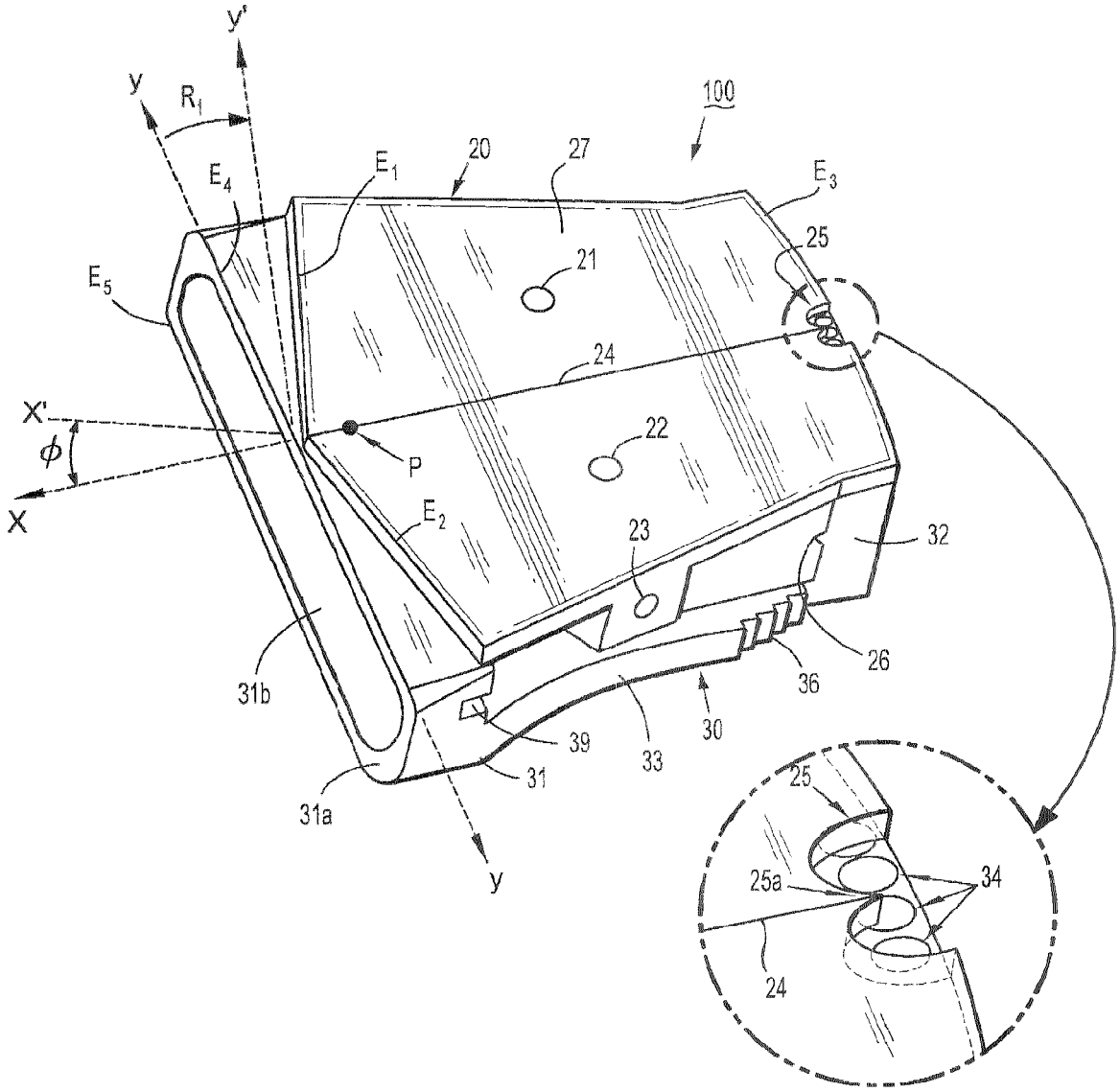
FIG. 2 is a schematic perspective view of an adjustable putter head comprising pivotally connected base and body members according to an exemplary embodiment of the invention.

FIG. 2 is a schematic perspective view of an adjustable club head (100) for a golf putter according to an exemplary embodiment of the invention. In general, the club head (10) comprises a body member (20) and a base member (30). The body (20) comprises a top planar surface (27) that is defined in part by tapered front edges E1 and E2 and an annular back edge E3. The body (20) includes various openings (21, 22 and 23) that are positioned and adapted to allow a shaft (not shown) to be connected to the body (20) on top or side surfaces thereof as desired for left-handed or right-handed players. The putter head can be used left or right handed, and has four interchangeable shaft attachment positions.

The body element (20) includes a fixed alignment line (24) (or aiming line) that longitudinally extends front to back along the top planar surface (27) of the body element (20). The alignment line (24) is in fixed orientation with the club shaft, and extends in the direction of intended putting motion to assist the golfer in lining up a putt square to a target line extending from a golf ball to a target point. For purposes of illustration, the alignment line (24) is depicted in FIG. 2 as extending in an x-direction.

The base (30) comprises a face plate (31) and a back plate (32) fixedly disposed on opposing ends of a planar base plate (33). The face plate (31) comprises planar surface providing a ball striking face (31*a*), which is defined in part by a first (top) edge E4 and second (bottom) edge E5 (which are shown for illustrative purposes as longitudinally extending in a y-direction). The ball striking face (31*a*) includes a friction/non-slip surface (31*b*) to provide a contact friction with a golf ball.

FIG. 2 schematically illustrates the body (20) and base (30) as assembled where the body (20) is essentially positioned over the base plate (33) between the face plate (31) and the back plate (32). The body member (20) and base member (30) are pivotally assembled to enable relative pivotal motion between the body (20) and base (30) about a pivot axis ($P_{axis}$) to allow angular adjustment of the striking face (31*a*), relative to the alignment line (24), according to general principles as discussed above.

More specifically, the body element (20) and base element (30) are joined together using a pivot assembly and structural framework for pivotally connecting the front portion of the body element (20) to the face plate (31). In FIG. 2, the body element (20) and base element (30) are pivotally connected for relative rotation about a pivot axis (vertical axis) which longitudinally extends in a z-direction through the body and base elements (20) and (30) and which intersects the alignment line (24) at a point P near the point of convergence of tapered edges E1 and E2 of body element (20).

Moreover, the body and base elements (20) and (30) are further joined using a retaining mechanism and structural framework to slideably secure the rear portion of the body (20) and the back plate (32) of the base (30). As discussed in further detail below with reference to FIGS. 5-7, for example, the body element (20) and back plate (32) may be slideably mated using various retaining mechanisms for controlling/guiding relative arcuate movement between the body (20) and back plate (32) when the body and base elements (20) and (30) are pivoted at the club face to adjust the angle of the strike face (31*a*) relative to the alignment line (24), as well as fixedly securing the body (20) and base (30) elements to maintain the adjusted angular orientation. For example, as discussed below, the body (20) may include an annular groove formed in a rear face thereof, which is engaged by a friction grip seated in the back plate (32) to retain the adjusted angular orientation.

The back plate (32) is provided with angle indicia (34) on a back edge of an upper surface thereof, which are used as indicator means for selectively adjusting the angular orientation of the putter face (31*a*) relative to the alignment line (24). An exemplary embodiment for implementing an angular indicia system for selectively adjusting the angular orientation of the face (31*a*) relative to the alignment line (24) will be discussed in further detail below with reference to FIGS. 8 and 9, for example. The planar surface (27) of the body element (20) comprises an opening (25) (sighting notch) formed on the back edge E3 for sighting the angle indicia (34). The opening (25) is formed having a pointer (25*a*) that is aligned to the alignment line (24) and used and a reference pointer to sight against the angular indicia (34). As explained below, the angular indicia (34) includes a zero or reference point marking that is pointed to by the pointer (25*a*) when the strike face (31*a*) is positioned square to the alignment line (24) (as illustrated in FIG. 2). The face angle, measured with respect to the reference position, can be selectively adjusted from the reference position to a desired offset angle in unit increments that are marked for a given granularity (e.g., in 1 degree increments).

Figure 3A:
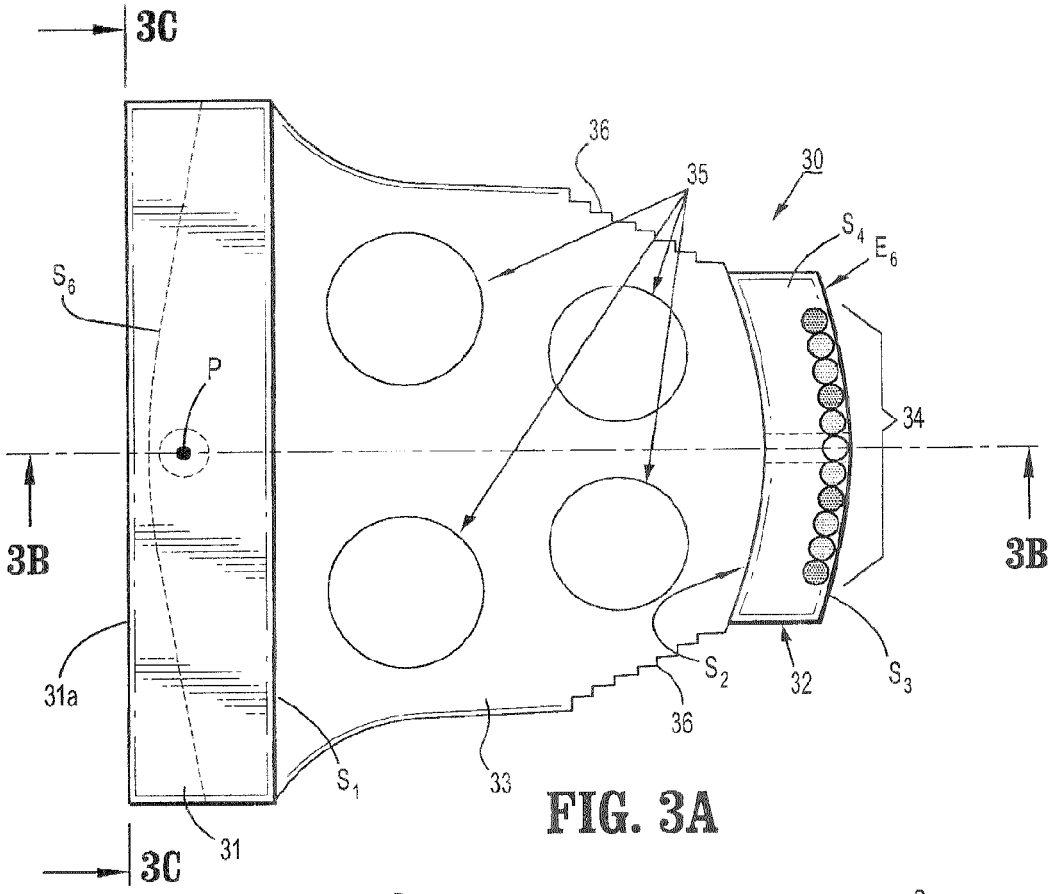
FIGS. 3A, 3B and 3C are schematic views of the base member of the exemplary putter head of FIG. 2, according to an exemplary embodiment of the invention.
Figure 3B:
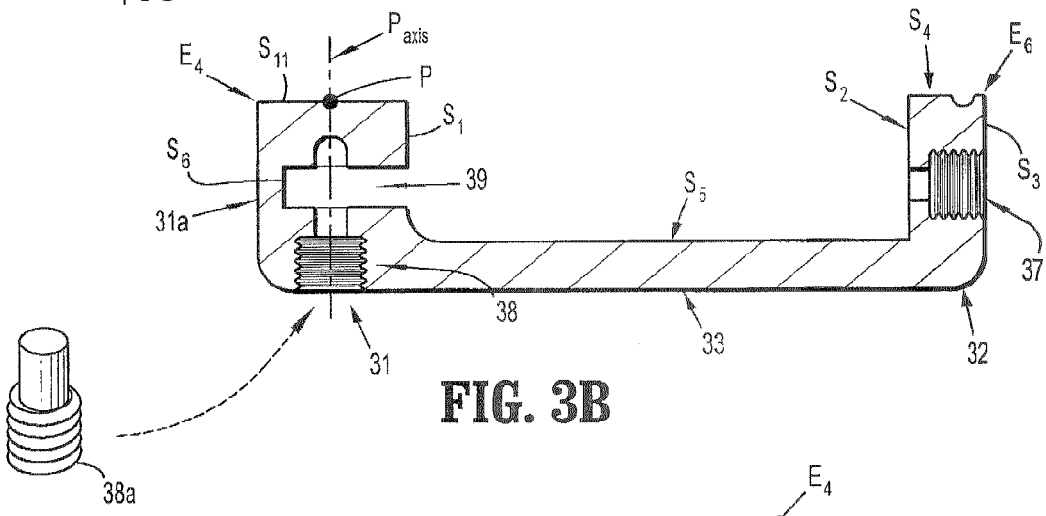
Figure 3C:
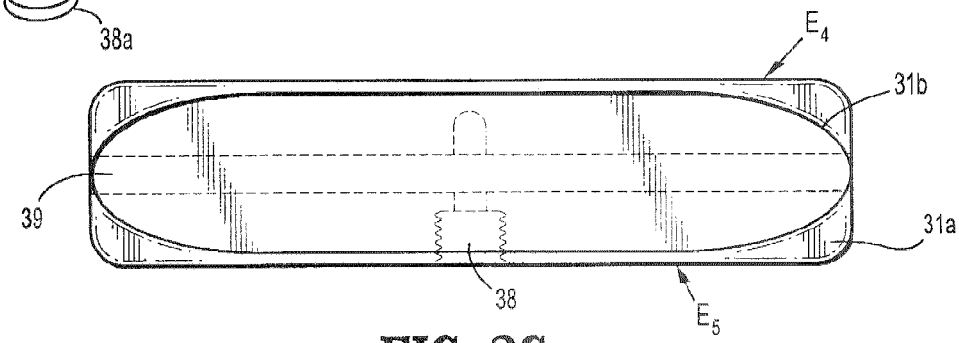
Figure 4A:
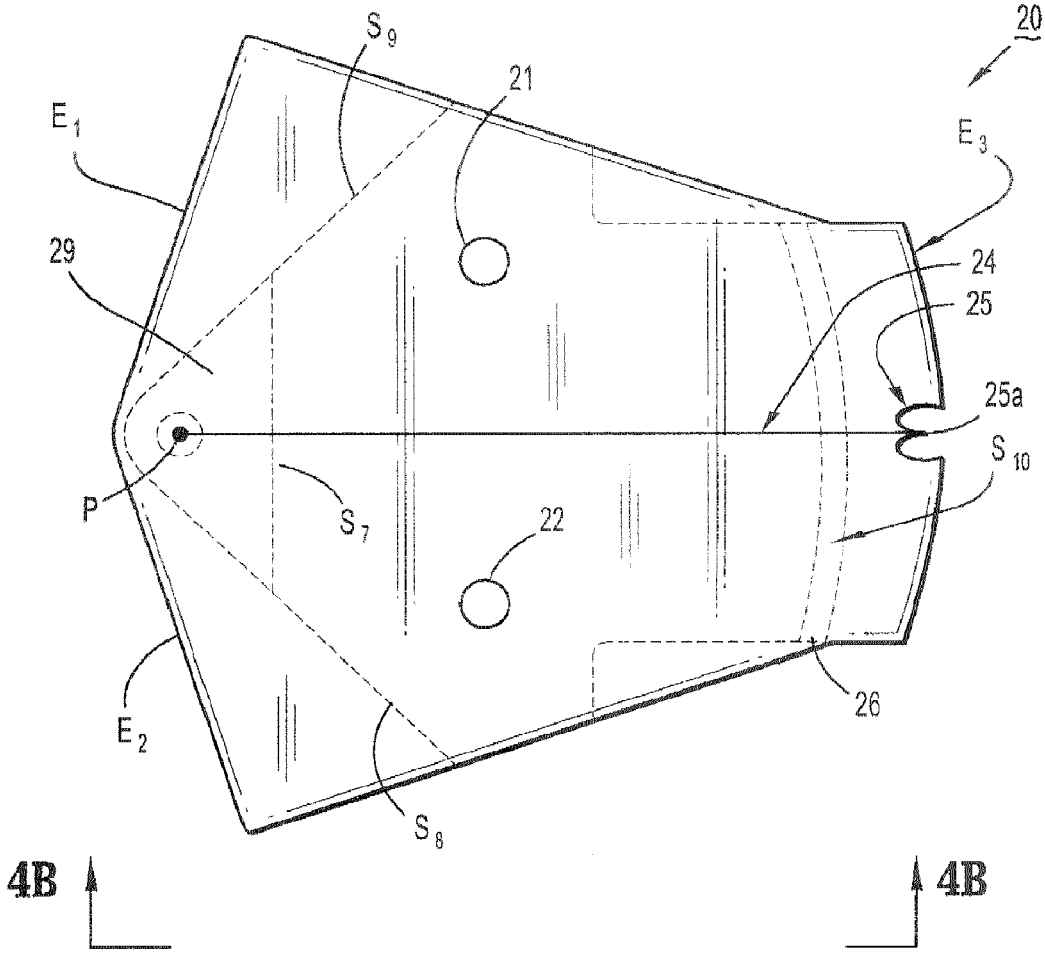
FIGS. 4A and 4B are schematic views of the body member of the exemplary putter head of FIG. 2 according to an exemplary embodiment of the invention.
Figure 4B:
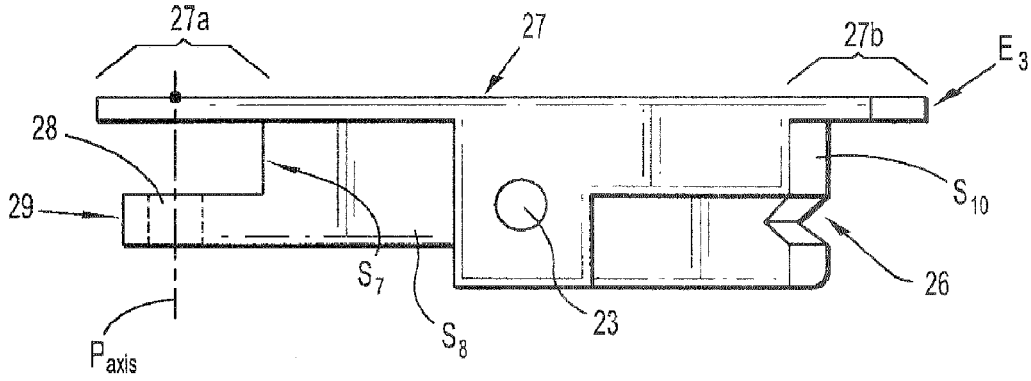

The body (20) and base (30) members of the exemplary putter head (100) are designed to have complementary structures that enable pivotal assembly and angular adjustment of the putter face (31) relative to the alignment line (24) for the intended applications. Details regarding the structural frameworks of the base (30) and body (20) members will now be discussed with reference to FIGS. 3A-3C and FIGS. 4A-4B, respectively. In particular, FIGS. 3A-3C are schematic views to illustrate structural details of the base member (30) of the adjustable club head (100) of FIG. 2 according to an exemplary embodiment of the invention, wherein FIG. 3A is a top plan schematic view of the base member (30), wherein FIG. 3B is a schematic cross-sectional view of the base member (30) along line 3B-3B in FIG. 3A, and wherein FIG. 3C is a schematic front view of the base member (30) along line 3C-3C in FIG. 3A. FIGS. 4A and 4B are schematic views to illustrate structural details of the body member (20) of the adjustable club head (100) according to an exemplary embodiment of the invention, wherein FIG. 4A is a top plan view of the body member (20) and wherein FIG. 4B is a schematic side view of the body member (20) along line 4B-4B in FIG. 4A.

As depicted in FIG. 3A, the base element (30) includes framework which is symmetrical about a dotted line 3B-3B which extends perpendicular to the planar striking face (31*a*) and which intersects the pivot point P of the pivot axis. The face plate (31) is planar shaped segment defined in part by the planar striking face (31*a*) and planar inner surface S1. The face plate (31) is designed to support pivotal connection with the body (20). The face plate (31) includes a groove (39) (or slot) formed in the inner surface S1 of the face plate (31), which extends along the entire length of the face plate (31) and opened on the side walls of the face plate (31) (as readily shown in FIG. 2). The groove (39) is formed having an inner surface S6 that is tapered. A threaded bore hole (38) is formed in the bottom of the face plate (31), where the center of the bore (38) is aligned to the pivot axis. The bore hole (38) is designed to threadably receive a pivot pin (38*a*) to pivotally engage a complementary flange structure of the body (20), as explained below.

The back plate (32) is an arc-shaped element defined in part by an inner annular surface S2 and outer annular surface S3, which are concentric with the pivot point P. A plurality of angular indicia (34) are arranged on an upper surface S4 of the back plate (32) along an outer edge E6 thereof, wherein the angular indicia (34) markings are arcuately arranged to be concentric with the pivot point. The back plate (32) includes a threaded bore hole (37) that is formed to extend through the back plate (32) between the annular surfaces S2 and S3. In the exemplary embodiment, the bore hole (37) has a longitudinal axis aligned with the line of symmetry 3B-3B through the pivot point P and perpendicular to the pivot axis.

The base plate (33) is essentially planar having an upper surface S5 that is essentially orthogonal to the inner surfaces S1 and S2 of the respective face and back plates (31) and (32). A plurality of relief holes (35) are formed in the base plate (33) for purposes of achieving a desired weight and balance for the adjustable putter (100). The base plate (33) comprises ridged sidewall regions (36) along the backside thereof to provide means for manually gripping the base (30) for pivotal adjustment relative to the body (20).

As illustrated in FIG. 4A, the body element (20) includes an elongated tapered framework which is symmetrical about the alignment line (24) formed on the top planar surface (27) of the body (20). The alignment line (24) may be formed using known techniques (e.g., the alignment line (24) may be an etched groove, imprinted line, raised elongated surface, etc.) The hosels (21) and (22) and alignment line (24) are arranged such that the alignment line (24) is perpendicular (900) to the putter shaft at all times. In FIG. 4A, the shape of the planar surface (27) is defined in part by tapered front edges E1 and E2 and an annular back edge E3. The planar top surface (27) of the body (20) includes extended portions (27*a*) and (27*b*). The portion of the body (20) below the surface (27) is defined, in part by inner vertical surfaces including surfaces denoted S7, S8, S9 and S10, which are illustrated as dotted lines in FIG. 4A. The body (20) is formed with structures that are complementary to those structures on the face plate (31) and back plate (32).

For instance, as clearly depicted in FIG. 4B, the front portion of the body (20) includes a flange (29) with a bore hole (28) formed to align with the pivot axis. The flange (29) is essentially a triangular shaped structure as seen in FIG. 4A) that is disposed below the extended portion (27*a*) of the surface, and having a base edge defined by an inner surface S7. The body (20) and base (30) are pivotally connected by inserting the flange (29) of the body (20) into the groove (39) of the face plate (31) with the bore hole (28) of the flange (29) aligned to the bore hole (28) of the face plate (31). When aligned, a pivot pin (38*a*) can be threadably inserted into the opening of the bore hole (38) of the base (30) extending through the aligned bore holes (38) and (28) so as to pivotally secure the flange (29) in the groove (39). When assembled, the extended portion (27*a*) of the surface (27) of the body (20) is disposed (overlaps) over an upper surface S11 of the face plate (31). This arrangement enables the beginning point of the alignment line (24) to be positioned in close proximity to the strike face (31*a*) to point at the sweet spot. Moreover, to limit the amount of angular rotation about the pivot axis, the beginning portions of inner surfaces S8 and S9 (as depicted in FIGS. 4A and 4B), which define the flange (29), are designed to make contact with the respective tapered portions of the inner surface S6 of the groove (39) in the face plate (31).

Moreover, the body (20) has an annular surface S10 having a center of curvature that is concentric about pivot point. When the body (20) and base (30) are assembled, the annular surface S10 of the body (20) is disposed adjacent the inner annular surface S2 of the back plate (32) of base (30), with the extended surface portion (27*b*) disposed over the upper surface (S4) of the back plate (32). The annular surface S10 includes an arcuate groove/slot (26) formed therein, which is aligned to the bore hole (37) formed in the back plate (32). A threaded stud element is threadably inserted into the bore hole (37) to extend into, and frictional or seatingly engage, the groove (26), depending on the groove/stud configuration, exemplary embodiments of which will now be described with reference to FIGS. 5, 6 and 7.

Figure 5A:
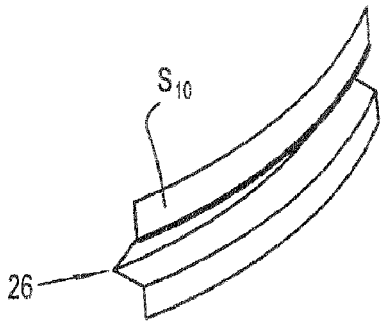
FIGS. 5A and 5B schematically illustrate a mechanism for controlling pivotal adjustment between the base and body members of the putter head, according to an exemplary embodiment of the invention.
Figure 5B:
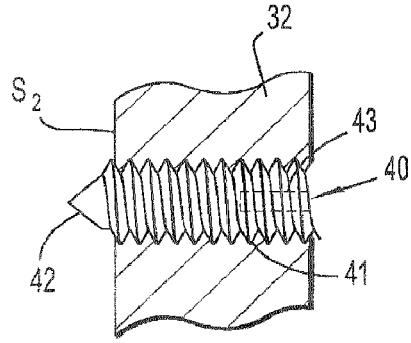

For instance, FIGS. 5A and 5B schematically illustrate a mechanism for controlling pivotal adjustment between the base (30) and body (20) members of the putter head (100), according to an exemplary embodiment of the invention. FIG. 5A is a schematic perspective view of a portion of annular surface S10 of the body element (20) wherein the arcuate groove (26) comprises a v-shaped groove formed in the annular surface S10 of the body (20). FIG. 5B illustrates a set screw (40) screwed into the bore hole (37) formed through the back plate (32), wherein the set screw (40) comprise a threaded shaft (41) and head (42), where the head (42) is shaped to frictionally engage the inner surfaces of the v-shaped groove (26) with the proper resistance to securely engage or slideably engage the body and base members. In particular, the set screw (40) has a slot (43) may be adjustable with the aid of an ordinary screw driver inserted into the slot (43) to tighten the screw (40) loosen the screw (40) to cause the striking face (31*a*) to assume various angular positions relative to the alignment line (24). When the screw (40) is driven home, the head (42) is driven into secured engagement within the groove (26) and the two surfaces S10 and S2 are firmly locked into adjusted positions.

Figure 6A:
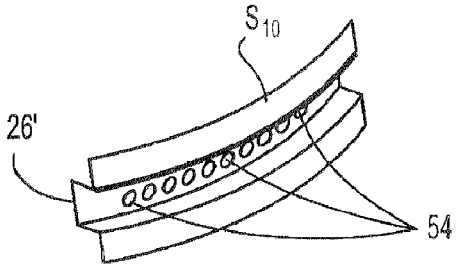
FIGS. 6A and 6B schematically illustrate a mechanism for controlling pivotal adjustment between the base and body members of the putter head, according to another exemplary embodiment of the invention.
Figure 6B:
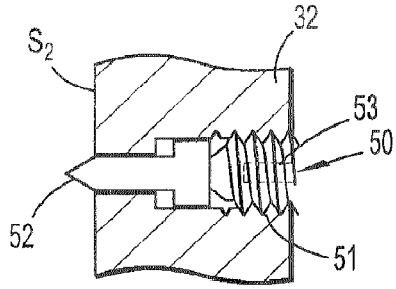

FIGS. 6A and 6B schematically illustrate a mechanism for controlling pivotal adjustment between the base (30) and body (20) members of the putter head (100), according to another exemplary embodiment of the invention. FIG. 6A is a schematic perspective view of a portion of annular surface S10 of the body element (20) having an arcuate groove (26') formed in the annular surface S10 of the body (20), wherein a sequence of arcuately spaced dimples (54) are formed on an inner surface of the slot (26'). FIG. 6B illustrates a set screw (50) screwed into the bore hole (37) formed through the back plate (32), wherein the set screw (50) comprise a threaded shaft (51) and pin head (52), where the pin head (52) is shaped to insertably engage a desired one of the dimples (54) on the inner surfaces of the slot (26'). The arcuate sequence of dimples are formed such that each dimple is coincident with a corresponding ones of the angular markings (24) provided in the arcuate sequence of angular indicia (24) formed on an upper surface S4 of the back plate (32). The set screw (50) has a slot (53) to be adjustable with the aid of an ordinary screw driver inserted into the slot (43) to tighten the screw (50) loosen the screw (50) to engage the pin head (52) into a desired one of the dimples (54) to set the desired angular position of the striking face (31*a*) relative to the alignment line (24).

Figure 7A:
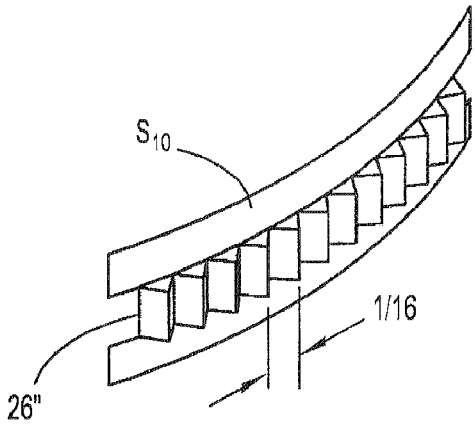
FIGS. 7A and 7B schematically illustrate a mechanism for controlling pivotal adjustment between the base and body members of the putter head, according to an exemplary embodiment of the invention.
Figure 7B:
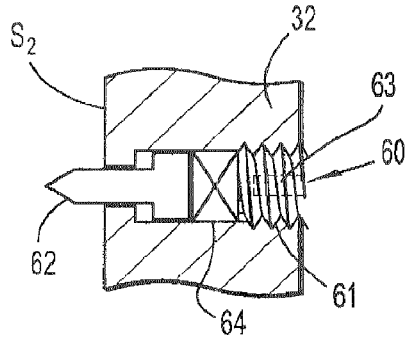

FIGS. 7A and 7B schematically illustrate a mechanism for controlling pivotal adjustment between the base and body members of the putter head, according to yet another exemplary embodiment of the invention. In FIG. 7A, an arcuate toothed groove (26") is formed extending inwardly on the arcuate surface S10 of the body (20). In FIG. 7B, a set screw (60) is in the form of a spring loaded plunger having a threaded shaft (61), plunger head (62) and spring mechanism (64) disposed between the shaft (61) and plunger head (62). The arcuate toothed groove (26") provides a series of wedge-shaped detents in which the retractable plunger head (62) is seatingly engaged/disengaged by spring action. The set screw (60) may be designed to allow angular rotation by applying sufficient pivotal force to permit the set screw (60) to engage/disengage each graduated wedge-shaped detent so that angular position can be adjusted by clicking action. As with the exemplary embodiment of FIGS. 6A and 6B, the wedge-shaped detents of the toothed groove (26") can be formed coincident with corresponding ones of the angular markings provided in the arcuate sequence of angular indicia (24) formed on an upper surface S4 of the back plate (32).

Figures 8, 9:
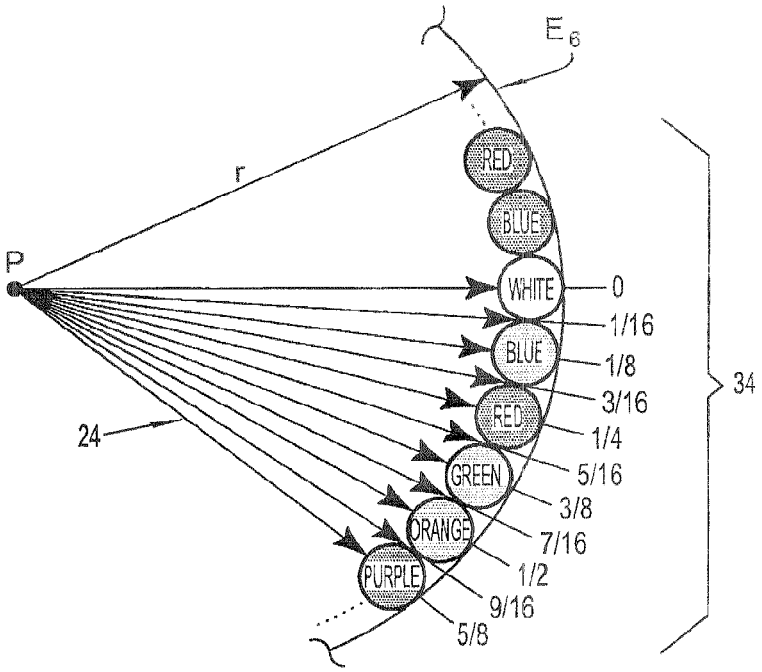
FIG. 8 schematically illustrates an angular indicia measuring system for selectively adjusting the angular position of the face plate and body according to an exemplary embodiment of the invention.
FIG. 9 is an exemplary table diagram illustrating an exemplary set of parameters that may be used as a reference to determine a desired angular position of the face plate and body as a function of breaking distance (offset of target point from a target hole) and distance from the ball to the target hole, as determined from a green reading.

An angular indicia measuring system for selectively adjusting the angular position of the face plate and body according to an exemplary embodiment of the invention, will now be discussed with reference to the exemplary embodiments of FIGS. 8 and 9. FIGS. 8 and 9 illustrate a method for selectively adjusting angular position of the putting face (31*a*) relative to the alignment line (24) according to an exemplary embodiment of the invention. In particular, FIGS. 8 and 9 illustrate a measurement system in which the angular adjustment of the striking face (31*a*) relative to the alignment line (24) can be determined as a function of the offset distance of a target point to a target hole and the putting distance from a golf ball to the target hole.

Referring to FIG. 8, in one exemplary embodiment, the angular indicia (34) formed on the upper surface S4 of the back plate (32) of the base element (30) comprises an arcuate sequence of colored circles that are arranged along the edge E6 of the upper surface (S4). The edge E6 is arcuate and essentially defines a portion of a perimeter of a circle concentric with the pivot point P having a radius r. The sequence of colored circles (34) are arranged along the edge E6 so as to be concentric with the pivot point P. The circles (34) are dimensioned to have the same diameter such that locations of the edges and centers of the circles delineate unit positions along the peripheral edge E6. For example, each circle may be dimensioned to be ⅛ of an inch in diameter to enable a granularity of 1/16 inch (defined by the distance between adjacent centers and edges of the circles.

In FIG. 8, the reference position is designated by the center of the "white" circle. When the pointer (25*a*) is pointing to the center of the white circle, the alignment line (24) is square to the striking face (31*a*). As the base member (30) is rotated relative to the body (20), the alignment line (24) (which is coincident with the indicator (25*a*)) moves about the perimeter edge E6 away from the zero reference point to some position aligned to a desired mark (e.g., center or edge of circle), which translates to some angular offset based on the radial distance r. This angular offset represents the angular offset of the putting face (31*a*) relative to the alignment line (24) which is selected to provide an desired off line target path toward a target point, which is offset from the ball-to-hole target line in the aim line direction of the alignment line (24). The desired offset can be selectively adjusted by aligning the sighting mark (25*a*) to point to the centers or edges of an appropriate circle according to the exemplary parameters listed in the table diagram of FIG. 9, based on a break distance and distance to the target hole as determined by the golfer.

In particular, FIG. 9 is an exemplary table illustrating a method for adjusting the putter head according to the amount of offset (break distance) at a hole and distance to the hole. When making a breaking putt, the golfer will determine the amount of break to select a target point at some distance to the left or right of the target hole (e.g., inside left or right; 1 cup, 1½ cups, 2 cups, etc.). Based on the desired offset from the center of the hole, and on the distance from the ball to the target hole, the golfer can align the alignment line (24) to the desired position of the appropriated colored circle. By way of example, assuming that the golfer determines that that the amount of offset at the hole should be 3 inches (to left or right of the hole) with a putting distance of 5 feet from a target hole, FIG. 9 shows the required angular offset of the putter face (31) relative to the body (20) can be selected by rotating the body (20) relative to the base (30) so that the alignment line (24) points to the edge position between the "blue" and "red" circles as viewed through the sighting notch (25) to provide a 3/16 inch offset of the alignment line (24) from the reference position at the center line of the "white" circle. The colored circles enable the golfer to readily visualize the angular indicia markings and identify the angular position for ease of alignment.

By sighting the alignment line (24) on the top surface of the body (20), in conjunction with the angular indicia in the form of an arcuate sequence of colored circles, a golfer can line up a putt in the direction towards the target hole as a fixed target, while the hitting surface (i.e., the face of the putter) is angled with respect to the alignment line (24), thus producing the necessary off-line ball path, as determined by the golfer. When the putter head (100) is set to the zero reference position (no offset), the putter (100) can be used in a conventional fashion, whereby the alignment line (24) is a line of sight that is used to line up a putt in the direction of a target point (which may or may not be the target hole), while the angle of the striking face (31*a*) is positioned square to the alignment line (24) (i.e., the direction of intended ball movement is in the direction of the putting motion). In this manner, a golfer can control his/her level of "handicap" at his/her own discretion.

On the other hand, when making a breaking putt, the golfer can select a target point offset at some distance to the left or right of a target hole, and selectively adjust the putter head (100) to set the angular position of the body (20) relative to the face (31) based on the offset distance of the target point and distance from the ball to the target hole. When properly aligned, the golfer will be lining up the putt to aim at the target hole as a fixed target, rather than at some blind spot on the green (e.g., the selected target point offset to the left or right of the target hole), while the putter face will be orientated square to the direction of intended ball movement along the off line target path to the target point. By using the adjustable putter head in this fashion, within a moderate amount of practice time, an average golfer could determine exactly how the putter head behaves in his/her hands, and be able to relate the circle/alignment line relationship to thereby obtain an acquired feel for the resulting angle of travel ("break"). The adjustable putter head (100) can serve as a training device for beginning golfers who wish to practice their putting skills.

It is to be further appreciated that an adjustable putter head according to an exemplary embodiment of the invention may be used for purposes in addition to those discussed above with regard to lining up and making breaking putts. By way of example, as noted above, an adjustable putter head may be configured for use in a "square face angle" configuration, where the planar ball striking face is positioned perpendicular to the alignment line. In this configuration, when the alignment line is positioned to aim at some target point, the striking face is aligned square to the direction of a putt along a target line extending from the center of the ball to the target point. If the face angle of the ball striking face is maintained in square alignment to the target line at the time of ball contact, the ball will travel straight down the target line toward the target point.

In this regard, a "square face angle" configuration may be used, for instance, to make short putts directly aimed at a target hole (or other target point). However, if the face angle is not maintained square to the target line on impact, the ball will travel in an off-line path to the left or right of the target line. Any small amount of angular offset of the face angle from the direction square to the target line can result in a missed putt. Depending on the putting skills of the golfer or the type of putter used, the golfer may have difficulty in making a straight stroke while holding the face of the putter square to the intended target line direction. For example, when putting, a golfer may consistently strike the ball with some consistent deviation or misalignment of the face angle upon impact.

In this regard, an adjustable putter head according to an exemplary embodiment of the invention may be configured for an intended use where the face angle of the putter face is adjusted to some desired "open face angle" position or "closed face angle" position relative to the alignment line so as to compensate for misaligned putts. Assuming a right handed golfer, an "open face angle" denotes a position of the putter face that aligns to a right of the target line while a "closed face angle" denotes a position of the putter face when aligned to the left of the target line. On the other hand, assuming a left handed golfer, an "open face angle" denotes a position of the putter face that aligns to the left of the target line while a "closed face angle" denotes a position of the putter face when aligned to the right of the target line.

In this configuration, when addressing the ball, a golfer can line up a putt using the alignment line as a visual aid to aim the ball at some target point and align the putter head square to the direction of a putt along a target line extending from the center of the ball to the target point, while ensuring that the face angle of the putter face adjusted to some offset position relative to the alignment line, so as to compensate for some consistent deviation or misalignment of the face angle upon impact that may arise by virtue of a habitual improper putting stroke (e.g., arcing putting stroke) or by virtue of the structural design of the putter being used. In other words, the face angle can be adjusted to some offset face angle position (relative to the square face angle position) while using the alignment line to line up the putt in the same manner as the alignment line would be used as if the adjustable putter was set to a "square face angle" configuration, with the expectation that, e.g., the face angle of the putter head would actually be positioned square to the desired putting direction upon impact despite the face angle offset adjustment.

It is contemplated that an adjustable putter head according to an exemplary embodiment of the invention provides a framework that is compliant with USGA (United States Golf Association) rules regarding adjustable putters. An exemplary putter head assemblies according to the invention allow the angular orientation of the striking face relative to the aiming line to be selectively adjusted using standard tools, e.g., screw driver, Allen key, etc, for purposes of making breaking putts, etc., while meeting tournament rules. Adjustable putter heads according to the invention can be manufactured using conventional techniques and using materials that comply with USGA rules and regulations. For instance, the components of the putter head can be computer machined from solid metallic stock such as brass, aluminum, etc.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. An adjustable golf putter head, comprising:

a putter body comprising an alignment line formed on a top surface of the putter body, which extends and points in a direction that defines a putting direction of the putter head and which serves as a visual aid to align the putting direction of the putter head in a direction of a target line toward a target point, wherein the alignment line comprises an elongated center line marking that extends from a front portion to a back portion of the top surface of the body, wherein the alignment line points to a sweet spot region on the planar ball striking face; and a putter face having a planar ball striking face, wherein the putter face is pivotally connected to the putter body to selectively adjust a face angle of the putter face relative to the alignment line to one of a plurality of face angle positions including a square face angle position where the planar ball striking face is perpendicular to the alignment line, and open face angle and closed face angle positions where the planar ball striking face is not perpendicular to the alignment line, wherein the adjustable golf putter head further comprises face angle indicia providing a series of positional marks corresponding to different ones of the plurality of face angle positions, wherein a given face angle position is selected by aligning the alignment line to a corresponding positional mark.

2. The adjustable golf putter head of claim 1, wherein the face angle indicia comprises an arcuate sequence of colored circles, wherein the positional marks are delineated by centers and edges of the colored circles.

3. An adjustable golf putter head, comprising:

a face plate comprising a planar ball striking face; and a body member comprising an elongated alignment line formed on a top surface of the body member extending from a front portion to a back portion of the body member and pointing in a direction that defines a putting direction of the putter head and which serves as a visual aid to align the putting direction of the putter head in a direction of a target line toward a target point; and a back plate that slideably engages the back portion of the body member to control and guide relative pivotal motion between the body member and face plate, wherein the face plate is pivotally connected to the front portion of the body member to selectively adjust an angular position of the ball striking face relative to the alignment line between a reference position and an offset position, wherein at the reference position, the ball striking face is positioned at an angle perpendicular to the alignment line, whereby the alignment line serves as a visual aid to position the ball striking face square to the putting direction toward the target point; and wherein at the offset position, the ball striking face is positioned at an offset angle from the reference position, whereby the alignment lines serves as a visual aid to position the ball striking face square to an off-line direction at the offset angle relative to the putting direction pointed to by the alignment line.

4. The adjustable golf putter head of claim 3, wherein the alignment line comprises an elongated center line marking that extends from a front portion to a back portion of the top surface of the body, wherein the alignment line points to a sweet spot region on the planar ball striking face.

5. The adjustable golf putter head of claim 3, wherein an upper surface of the back plate comprises face angle indicia providing a series of positional marks corresponding to different ones of the plurality of angular positions of the ball striking face relative to the alignment line, wherein a given angular position is selected by aligning the alignment line to a corresponding positional mark.

6. The adjustable golf putter head of claim 5, wherein the face angle indicia comprises an arcuate sequence of colored circles arranged along an outer arcuate edge of the upper surface of the back plate, wherein the positional marks are delineated by centers and edges of the colored circles.

7. An adjustable golf putter head, comprising:

a base member comprising a face plate and a back plate fixedly disposed on opposing ends of a planar base plate, wherein the face plate comprises a planar ball striking surface; and a body member comprising an elongated alignment line formed on a top surface of the body member extending from a front portion to a back portion of the body member and pointing in a direction that defines a putting direction of the putter head and which serves as a visual aid to align the putting direction of the putter head in a direction of a target line toward a target point;

wherein the body member is pivotally assembled to the base member and disposed between the face plate and back plate, wherein a front portion of the body member is pivotally connected to the face plate to enable relative pivotal motion between the body member and the base member about a pivot axis to allow adjustment of an angular position of the ball striking face relative to the alignment line in a plane perpendicular to the pivot axis; and wherein a back portion of the body member is slideably mated to the back plate to adjustably control relative arcuate movement between the body member and the back plate upon relative pivotal movement between the body and base members, and to fixedly secure the body member and base member in an adjusted angular position.

8. The adjustable golf putter head of claim 7, wherein the alignment line comprises an elongated center line marking that extends from a front portion to a back portion of the top surface of the body member, wherein the alignment line points to a sweet spot region on the ball striking face.

9. The adjustable golf putter head of claim 8, wherein an upper surface of the back plate comprises face angle indicia providing a series of positional marks corresponding to different ones of a plurality of angular positions of the ball striking face relative to the alignment line, wherein a given angular position is selected by aligning the alignment line to a corresponding positional mark.

10. The adjustable golf putter head of claim 9, wherein the face angle indicia comprises an arcuate sequence of colored circles arranged along an outer arcuate edge of the upper surface of the back plate, wherein the positional marks are delineated by centers and edges of the colored circles.

* * * * *